US007061433B2

(12) United States Patent
Kim et al.

(10) Patent No.: US 7,061,433 B2
(45) Date of Patent: Jun. 13, 2006

(54) ANTENNA COUPLING DEVICE FOR MOBILE TERMINAL

(75) Inventors: Jae-Shik Kim, Seoul (KR); Hyon-Myong Song, Seoul (KR); Hong-Bae Kim, Yongin-shi (KR); Jong-Cheon Wee, Yongin-shi (KR)

(73) Assignee: Samsung Electronics Co,. Ltd (KR)

( * ) Notice: Subject to any disclaimer, the term of this patent is extended or adjusted under 35 U.S.C. 154(b) by 93 days.

(21) Appl. No.: 10/741,181

(22) Filed: Dec. 19, 2003

(65) Prior Publication Data

US 2005/0162319 A1 Jul. 28, 2005

(30) Foreign Application Priority Data

Dec. 24, 2002 (KR) ..... P10-2002-0083367

(51) Int. Cl.
*H01Q 1/24* (2006.01)
*H01Q 1/10* (2006.01)

(52) U.S. Cl. ..... 343/702; 343/889

(58) Field of Classification Search ..... 343/702, 343/895, 896, 889, 888, 900
See application file for complete search history.

(56) References Cited

U.S. PATENT DOCUMENTS 5,596,334 A 1/1997 Boyce et al. ..... 343/702
5,650,789 A * 7/1997 Elliott et al. ..... 343/702
5,764,191 A * 6/1998 Tsuda ..... 343/702
6,208,301 B1 * 3/2001 Sandgren et al. ..... 343/702
6,211,828 B1 * 4/2001 Krylov et al. ..... 343/702
2001/0001554 A1 * 5/2001 Oshiyama ..... 343/790

FOREIGN PATENT DOCUMENTS

EP 0 964 474 12/1999
EP 1 050 921 11/2000

* cited by examiner

*Primary Examiner*—Tan Ho
*Assistant Examiner*—Ephrem Alemu
(74) *Attorney, Agent, or Firm*—Dilworth & Barrese LLP

(57) ABSTRACT

An antenna coupling device for a mobile terminal adapted to couple, to a terminal body of the mobile terminal, an antenna unit including an antenna housing adapted to be coupled to the terminal body, and an antenna extending through the antenna housing into the terminal body at an inner end. The antenna coupling device includes an antenna coupling member rotatably fitted in the antenna housing at one end of the antenna housing facing the terminal body, and engaging elements for selectively engaging the antenna with the antenna coupling member to restrain the antenna coupling member by the antenna, causing the antenna coupling member to be coupled to an antenna bushing provided at the terminal body in accordance with rotation of the antenna.

16 Claims, 13 Drawing Sheets

ANTENNA COUPLING DEVICE FOR MOBILE TERMINAL

PRIORITY

This application claims priority to an application entitled "Antenna Coupling Device for Mobile Terminal" filed in the Korean Industrial Property Office on Dec. 24, 2002 and assigned Ser. No. 2002-83367, the contents of which are hereby incorporated by reference.

BACKGROUND OF THE INVENTION

1. Field of the Invention

The present invention relates to an antenna coupling device for a mobile terminal, and more particularly to an antenna coupling device for a mobile terminal which is configured to selectively restrain an antenna coupling member fitted in an antenna housing to rotate the antenna coupling member by rotation of an antenna of the mobile terminal.

2. Description of the Related Art

Generally, a "mobile communication terminal" is a device adapted to allow the user to conduct wireless communication with a counterpart. Such a mobile communication terminal includes a hand held phone (HHP), a cordless telephone 2 (CT-2), a cellular phone, a digital phone, a personal communication system (PCS) phone, a personal digital assistant (PDA), etc. These mobile wireless terminals are classified into a bar type, a flip type, and a folder type in terms of their outer structures. Such conventional mobile terminals are essentially equipped with an antenna unit, a data input/output unit, and a data transmitting/receiving unit. For the data input/output unit, a liquid crystal display (LCD) is commonly used. For the data input/output unit, a key pad or touch screen is commonly used. Basically, the keypad used to input data has an arrangement of a plurality of keys including a conversation start button, that is, a send (SND) key, a cancel key, a correction or clear (CLR) key, numeral keys, character keys, an end (END) key, function keys, a power (PWR) key, etc.

The antenna unit is mounted to a desired portion of a terminal body in the mobile terminal in order to receive a signal transmitted to the terminal. For such an antenna unit, a retractable antenna is mainly used which is a combination of a whip antenna and a helical antenna. An example of such a retractable antenna is illustrated in FIG. 1. As shown in FIG. 1, the retractable antenna includes a whip antenna 4 having a dummy rod 4*a*, a rod antenna 4*b*, and an antenna stopper 4*c*, and a helical antenna 5 having an antenna housing 5*a* internally provided with helical coils, and an antenna coupling member 5*b* coupled to an antenna bushing 2*a* fixed to a lower case frame 2 included in a terminal body 1 of a mobile terminal. The rod antenna 4*b* extends through the antenna housing 5*a* and antenna coupling member 5*b* such that it is extendable from and retractable into the terminal body 1.

Typically, there are two types of antenna coupling devices. In the case illustrated in FIG. 1, the first type antenna coupling device is used. The configuration of this first type antenna coupling device is shown in FIG. 2. In the first type antenna coupling device, the antenna coupling member 5*b* is formed at the antenna housing 5*a* such that it is integral with the antenna housing 5*a*, as shown in FIG. 2. The antenna coupling member 5*b* is adapted to be threadedly coupled with the antenna bushing 2*a* fixed to the lower case frame 2. In this case, the antenna has a circular cross-section, as shown in FIG. 3. The second type antenna coupling device is illustrated in FIG. 4. In this second type antenna coupling device, a hook-shaped coupling member 51 is formed at an antenna housing 50 such that it is integral with the antenna housing 50, as shown in FIG. 4. The hook-shaped coupling member 51 is adapted to be engaged, in a hooking fashion, with a rib (not shown) formed at the lower case frame 2. In this case, the antenna may have an oval or rectangular cross-section, as shown in FIG. 5*a* or 5*b*.

Where the first type antenna coupling device is used, the antenna housing having a circular cross-section can be reliably coupled with the antenna bushing in accordance with its rotation during assembly. However, where the antenna housing has an oval or rectangular cross-section a problem arises because it is necessary to use the second type antenna coupling device using the hooking method. Among the problems that arise, the rib may be easily damaged, or the hook coupling member may be inaccurately engaged with the rib. As a result, there may be a clearance space at the antenna housing, resulting in a loose antenna.

SUMMARY OF THE INVENTION

Therefore, an object of the invention is to provide an antenna coupling device for a mobile terminal which is configured to selectively restrain an antenna coupling member fitted in an antenna housing to rotate the antenna coupling member by rotation of an antenna of the mobile terminal, thereby being capable of easily coupling antenna units which may have diverse shapes.

Another object of the invention is to provide an antenna coupling device for a mobile terminal which includes an antenna coupling member separate from the antenna housing of an antenna unit, enabling disassembly of the antenna housing and antenna coupling member when the antenna unit is damaged, so that only the damaged element of the antenna unit can be replaced with a new one, thereby reducing maintenance costs.

Another object of the invention is to provide an antenna coupling device for a mobile terminal which includes an annular reinforcing member adapted to reinforce the coupling between the antenna housing of an antenna unit and an antenna coupling member, thereby enhancing the coupling force of the antenna unit, so that it is possible to prevent deformation of the antenna unit during use while avoiding formation of a clearance space at a terminal body of the mobile terminal.

In accordance with the present invention, these objects are accomplished by providing an antenna coupling device for a mobile terminal adapted to couple, to a terminal body of the mobile terminal, an antenna unit including an antenna housing adapted to be coupled to the terminal body, and an antenna extending through the antenna housing into the terminal body at an inner end thereof, comprising: an antenna coupling member rotatably fitted in the antenna housing at one end of the antenna housing facing the terminal body; and restraining means for selectively engaging the antenna with the antenna coupling member to restrain the antenna coupling member by the antenna, thereby causing the antenna coupling member to be coupled to an antenna bushing provided at the terminal body by rotation of the antenna.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE PREFERRED EMBODIMENT

Figure 1:
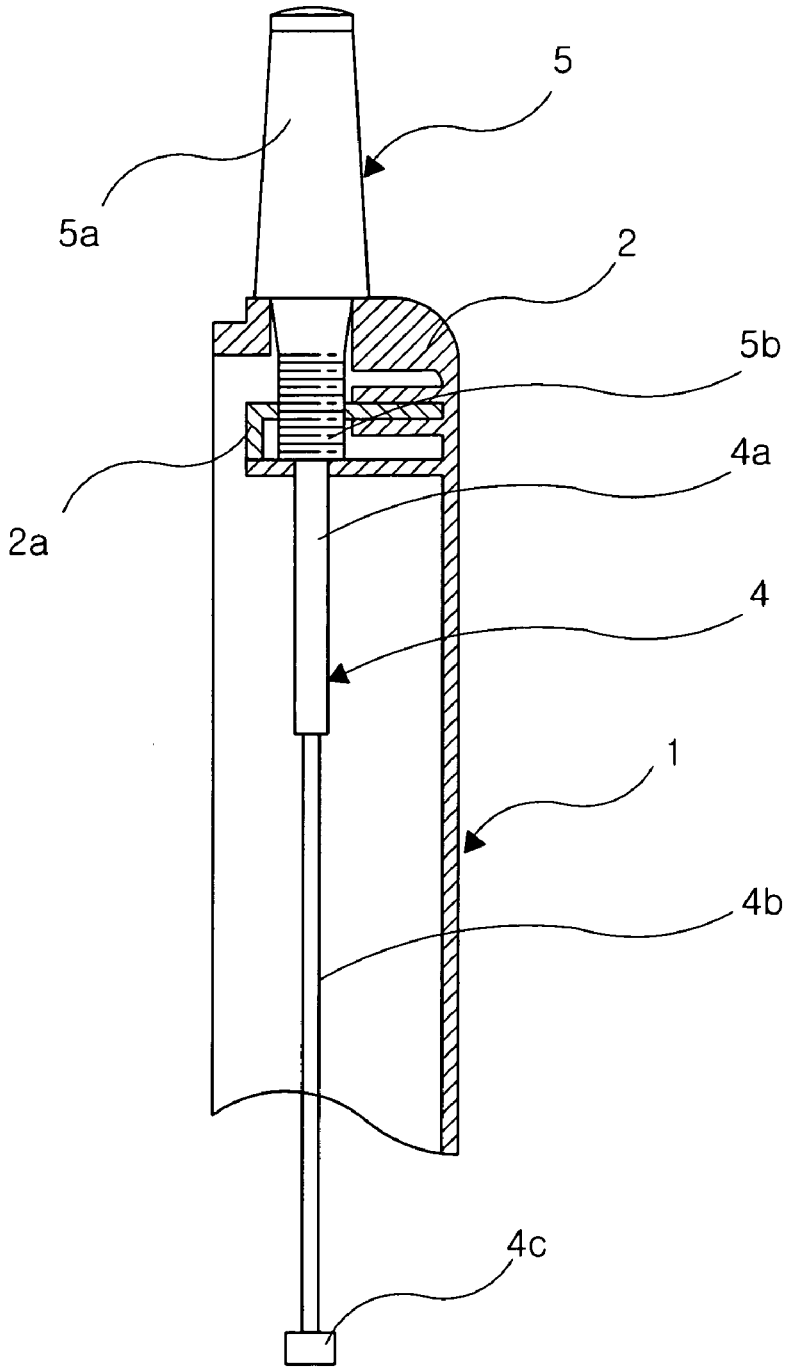
FIG.1 (PRIOR ART)
FIG. 1 is a sectional view illustrating an example of a conventional antenna coupling device for a mobile terminal.
Figure 2:
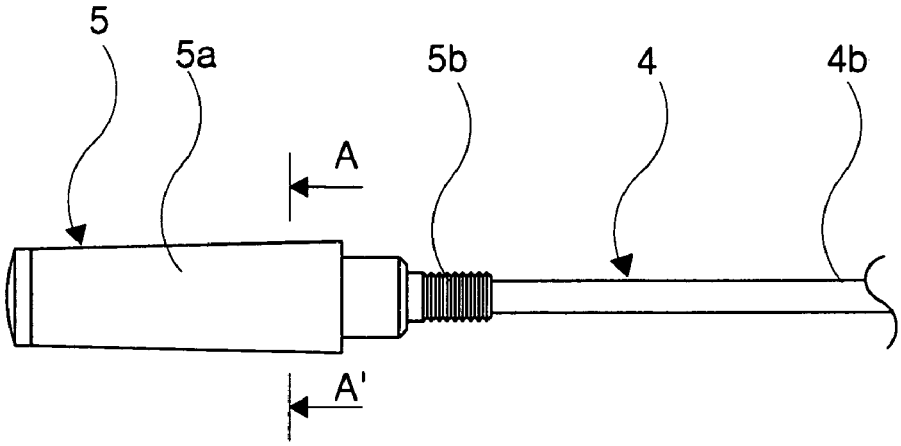
FIG.2 (PRIOR ART)
FIG. 2 is a perspective view illustrating the conventional antenna coupling device.
Figure 3:
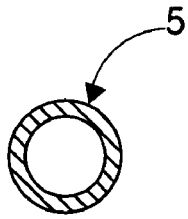
FIG.3 (PRIOR ART)
FIG. 3 is a cross-sectional view taken along the line A–A' of FIG. 2.
Figure 4:
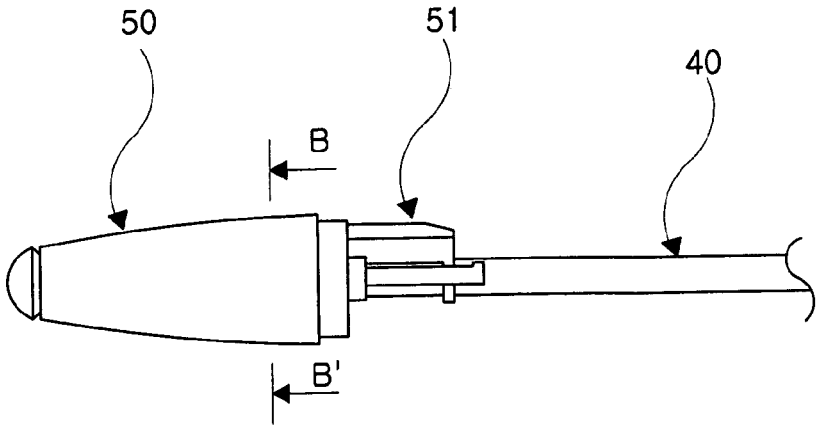
FIG.4 (PRIOR ART)
FIG. 4 is a perspective view illustrating another example of a conventional antenna coupling device for a mobile terminal.
Figure 5A:
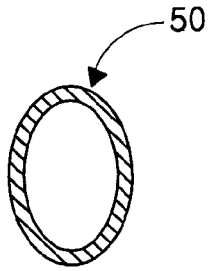
FIG.5A (PRIOR ART)
FIG. 5*a* is a cross-sectional view taken along the line B–B' of FIG. 4.
Figure 5B:
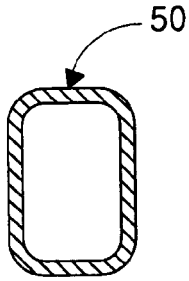
FIG.5B (PRIOR ART)
FIG. 5*b* is a cross-sectional view similar to FIG. 5*a*, illustrating another antenna housing.

Now, preferred embodiments of the present invention will be described in detail with reference to the annexed drawings.

Referring to FIGS. 6 to 14, 16, 17, and 19, an antenna unit for a mobile terminal is illustrated which includes an antenna coupling device according to an embodiment of the present invention. The antenna unit includes an antenna housing 100 internally provided with a helical antenna 1000 consisting of helical coils, an antenna 200, a hollow antenna coupling member 400, and restraining means 500. The antenna coupling member 400 is arranged at a lower end of the antenna housing 100 such that it is rotatable for coupling to a terminal body. The antenna coupling member 400 is separate from the antenna housing 100. The restraining means 500 serves to selectively engage the antenna 200 with the antenna coupling member 400, thereby allowing the antenna coupling member 400 to be rotated along with rotation of the antenna 200. The restraining means 500 comprises an engaging element provided at a portion of the antenna 200 positioned near an antenna stopper 201 formed at an inner end of the antenna 200 received in the terminal body 1, and another engaging element provided at one end of the antenna coupling member 400 fitted in the antenna housing 100. The antenna coupling member 400 protrudes from the antenna housing 100 at the other end thereof. The antenna coupling member 400 is provided at the other end thereof with threads so that it can be threadedly coupled with an antenna bushing 2*a* fixed to a lower case frame 2 of the mobile terminal. The antenna coupling member 400 is preferably made of a metal material, taking into consideration the frequency characteristics of the antenna unit.

An annular reinforcing member 300 is interposed between the antenna housing 100 and the antenna coupling member 400. A stopper 401 radially protrudes from the outer circumferential surface of the antenna coupling member 400 near one end of the antenna coupling member 400, so as to prevent the antenna coupling member 400 from being separated from the annular reinforcing member 300, and thus, the antenna housing 100. The antenna coupling member 400 is rotatable within the annular reinforcing member 300. The annular reinforcing member 300 is also preferably made of a metal material, taking into consideration the frequency characteristics of the antenna unit.

Herein, the antenna coupling member 400 is coupled with the annular reinforcing member 300 and then, the stopper 201 which is the ending portion of the antenna 200 is forcibly pushed or inserted to the antenna coupling member 400 to thereby coupled with the antenna 200 by punching operation.

The restraining means 500 comprises, for the engaging elements thereof, a rod-shaped stopper 501 provided at a portion of the antenna 200 positioned near the antenna stopper 201 and preferably has a polygonal cross-section. The restraining means 500 further comprises a stopper bore 502 formed at one end of the antenna coupling member 400, which also preferably has a polygonal cross-section corresponding to that of the rod-shaped stopper 501. When it is desired to threadedly couple the antenna coupling member 400 with the antenna bushing 2*a*, the rod-shaped stopper 501 is engaged with the stopper bore 502 so that the antenna coupling member 400 can be rotated along with rotation of the antenna 200. An inclined guide surface 700 (see FIG. 9) is formed at one end of the stopper bore 502 facing the antenna stopper 201. The inclined guide surface 700 comes into contact with an end of the rod-shaped stopper 501 opposite to the antenna stopper 201, thereby guiding the rod-shaped stopper 501 into the stopper bore 502. The stopper bore 502 preferably has a regular hexagonal shape. The rod-shaped stopper 501 has a size such that its diameter of its circumscribed circle is larger than the diameter of the antenna 200. The antenna coupling member 400 has a circular bore 800 extending axially from the stopper bore 502 through the antenna coupling member 400. The circular bore 800 serves to receive the rod-shaped stopper 501 separated from the stopper bore 502 when the antenna 200 is retracted into the terminal body 1. The circular bore 800 has a diameter larger than the diameter of the circumscribed circle of the rod-shaped stopper 501 so as to prevent the antenna coupling member 400 from being restrained by the antenna 200. A guide tube 600 (FIG. 10) is connected to the circular bore 800 in order to guide a sliding movement of the antenna 200 therethrough.

Now, another embodiment of the present invention associated with the restraining means will be described with respect to FIGS. 15 and 18.

In accordance with this embodiment, the restraining means 500 comprises a rod-shaped stopper 501' extending from the inner end of the antenna 200 received in the terminal body. As shown in FIG. 15, the rod-shaped stopper 501' is provided at a circumferential surface thereof with a plurality of first protrusions 501*a* extending longitudinally along the rod-shaped stopper 501', and a plurality of first grooves 501*b* each extending longitudinally along the rod-shaped stopper 501' while being arranged between adjacent ones of the first protrusions 501*a*. Although not shown, the rod-shaped stopper 501' may have one first protrusion 501*a*, and one first groove 501*b*. In accordance with this embodiment, the restraining means 500 also comprises a stopper bore 502' formed at one end of the antenna coupling member 400, and adapted to engage with the rod-shaped stopper 501'. As shown in FIG. 18, the stopper bore 502' is provided at a circumferential surface thereof with a plurality of second protrusions 502*a* extending longitudinally along the stopper bore 502', and a plurality of second grooves 502*b* each extending longitudinally along the stopper bore 502' while being arranged between adjacent ones of the second protrusions 502*a*. Although not shown, the stopper bore 502' may have one second protrusion 502*a*, and one second groove 502*b*. The first protrusions and grooves 501*a* and 501*b* are engagable with the second grooves and protrusions 502*b* and 502*a*, respectively. In the illustrated case, the rod-shaped stopper 501' has a star shape. The protrusions and grooves 502*a* and 502*b* of the stopper bore 502' are symmetrically arranged. When the antenna 200 completely protrudes from the antenna housing 100, the rod-shaped stopper 501' faces the helical antenna 100. The rod-shaped stopper 501' has a size such that the diameter of its circumscribed circle is larger than the diameter of the antenna 200. Similarly to the previously-described embodiment, the antenna coupling member 400 has a circular bore 800 extending axially from the stopper bore 502' through the antenna coupling member 400. The circular bore 800 serves to receive the rod-shaped stopper 501' separated from the stopper bore 502' when the antenna 200 is retracted into the terminal body 1. The circular bore 800 has a diameter larger than the diameter of the circumscribed circle of the rod-shaped stopper 501' so as to prevent the antenna coupling member 400 from being restrained by the antenna 200. A guide tube 600 is connected to the circular bore 800 in order to guide a sliding movement of the antenna 200 therethrough.

Now, the assembling procedure and operation of the antenna coupling device having the above described configuration according to the first embodiment (FIGS. 6–14) of the present invention will be described in detail with reference to the annexed drawings.

Figure 6:
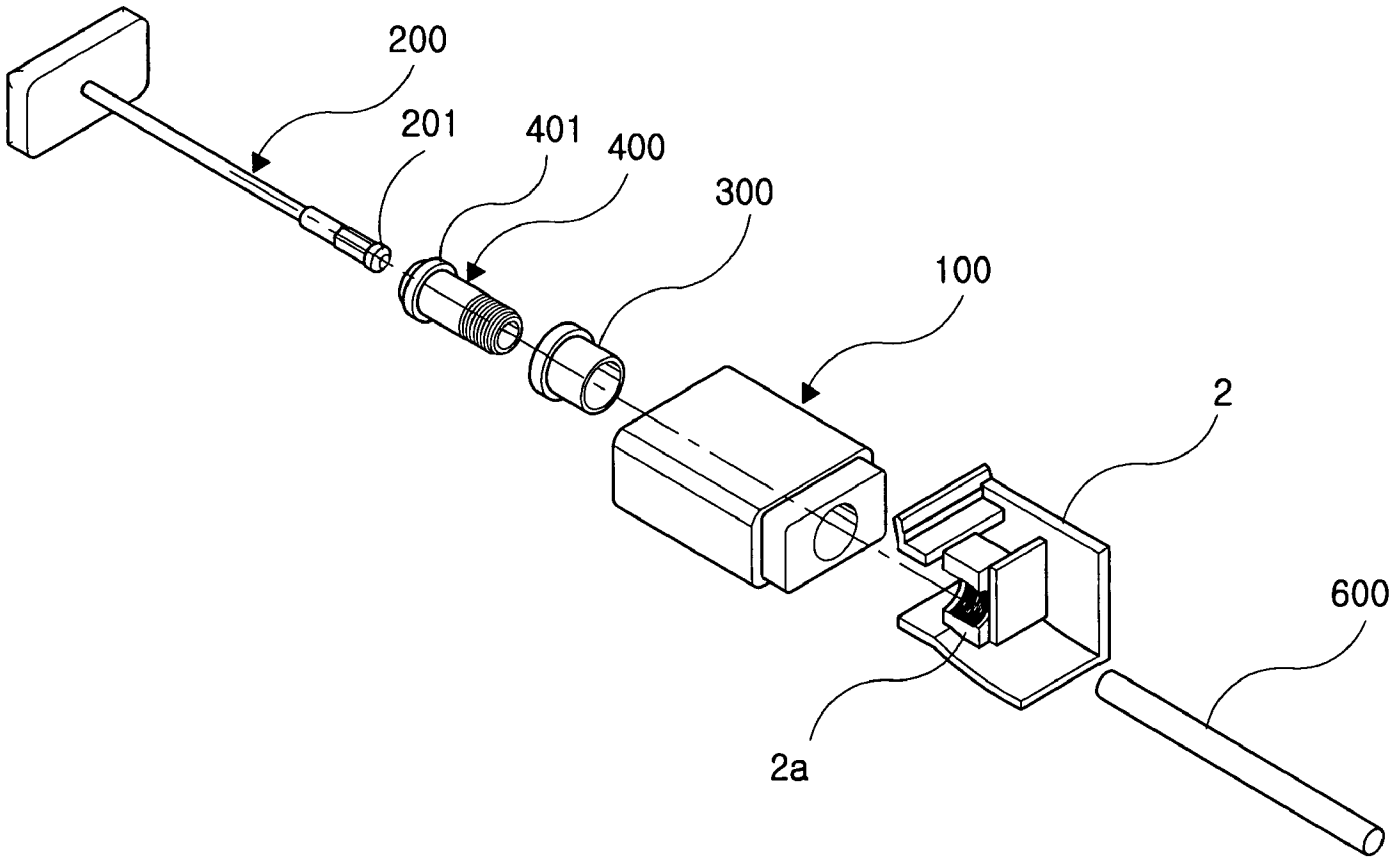
FIG. 6 is an exploded perspective view illustrating the configuration of an antenna coupling device for a mobile terminal in accordance with a first embodiment of the present invention.
Figure 7:
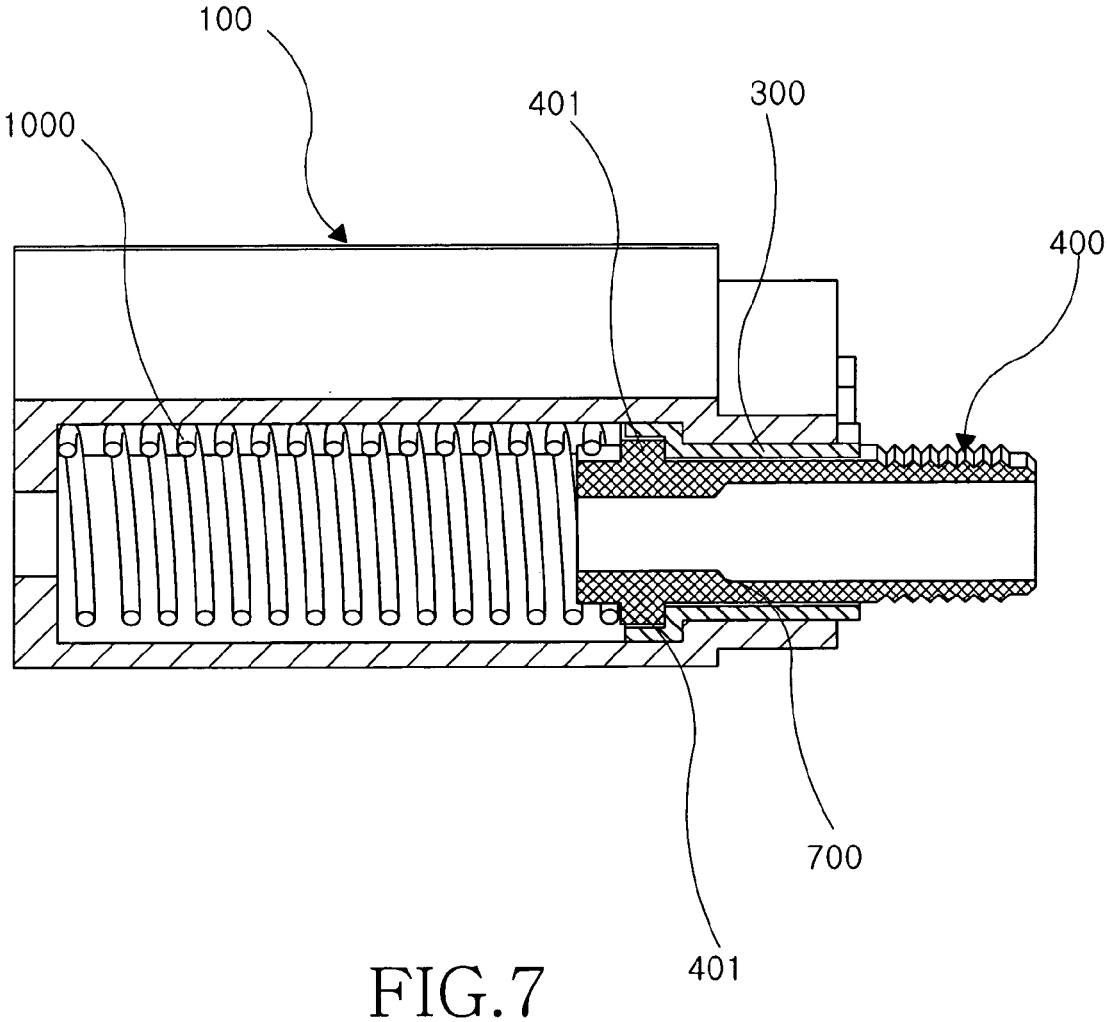
FIG. 7 is a sectional view illustrating a part of the antenna coupling device according to the first embodiment of the present invention in which an antenna coupling member included in the antenna coupling device is fitted in an antenna housing.
Figure 8:
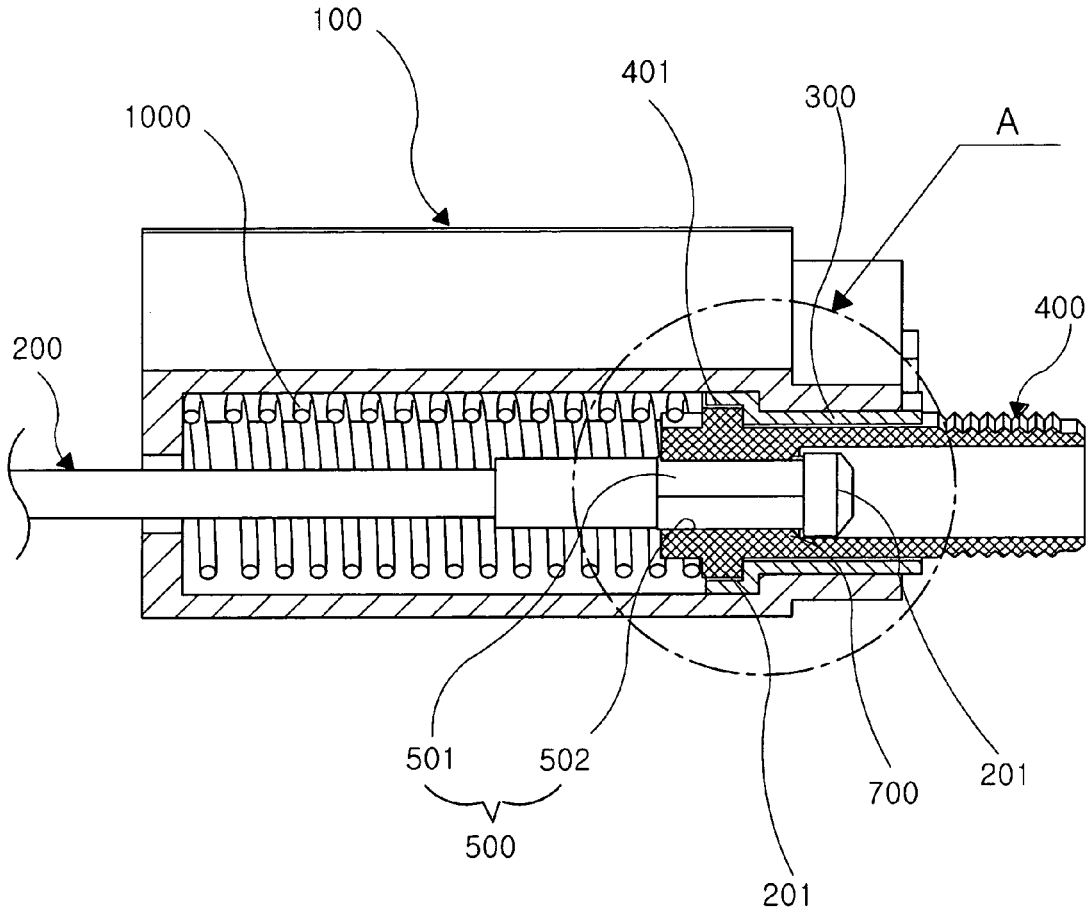
FIG. 8 is a sectional view illustrating a part of the antenna coupling device according to the first embodiment of the present invention in which a rod-shaped antenna is engaged with the antenna coupling member included in the antenna coupling device to restrain the antenna coupling member.
Figure 9:
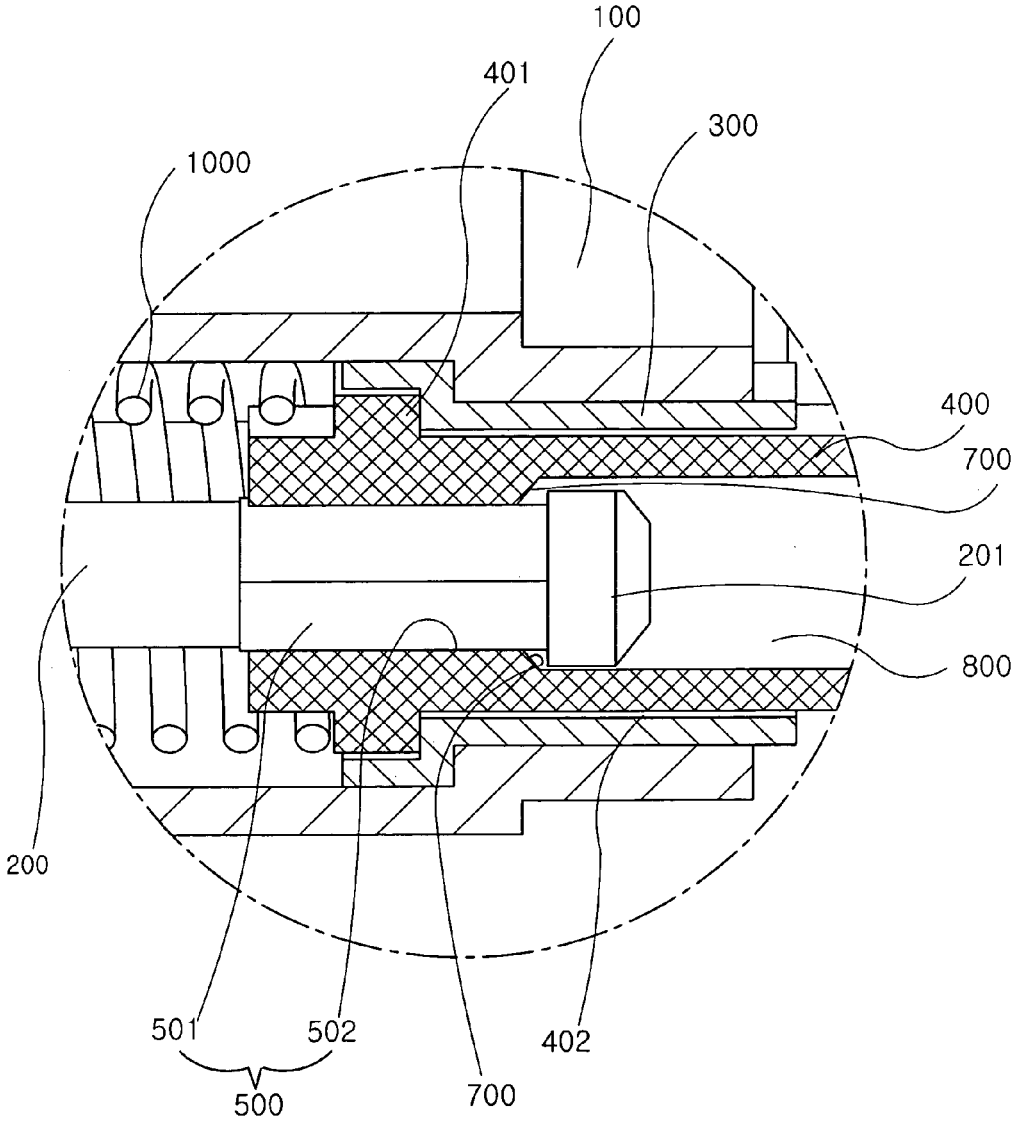
FIG. 9 is an enlarged view corresponding to a portion "A" of FIG. 8.

In order to mount the antenna housing 100 to the lower case frame 2 of the terminal body 1 in the mobile terminal, the antenna coupling member 400 is first mounted to the lower end of the antenna housing 100, as shown in FIGS. 6 and 9. At this time, the annular reinforcing member 300 adapted to reinforce the coupling force of the antenna coupling member 400 is interposed between the antenna housing 100 and the antenna coupling member 400. That is, the antenna coupling member 400 is fitted in the annular reinforcing member 300 such that it is simultaneously rotatable. Thereafter, the antenna 200 is inserted into the antenna coupling member 400 such that it extends through the antenna housing 100.

Figure 10:
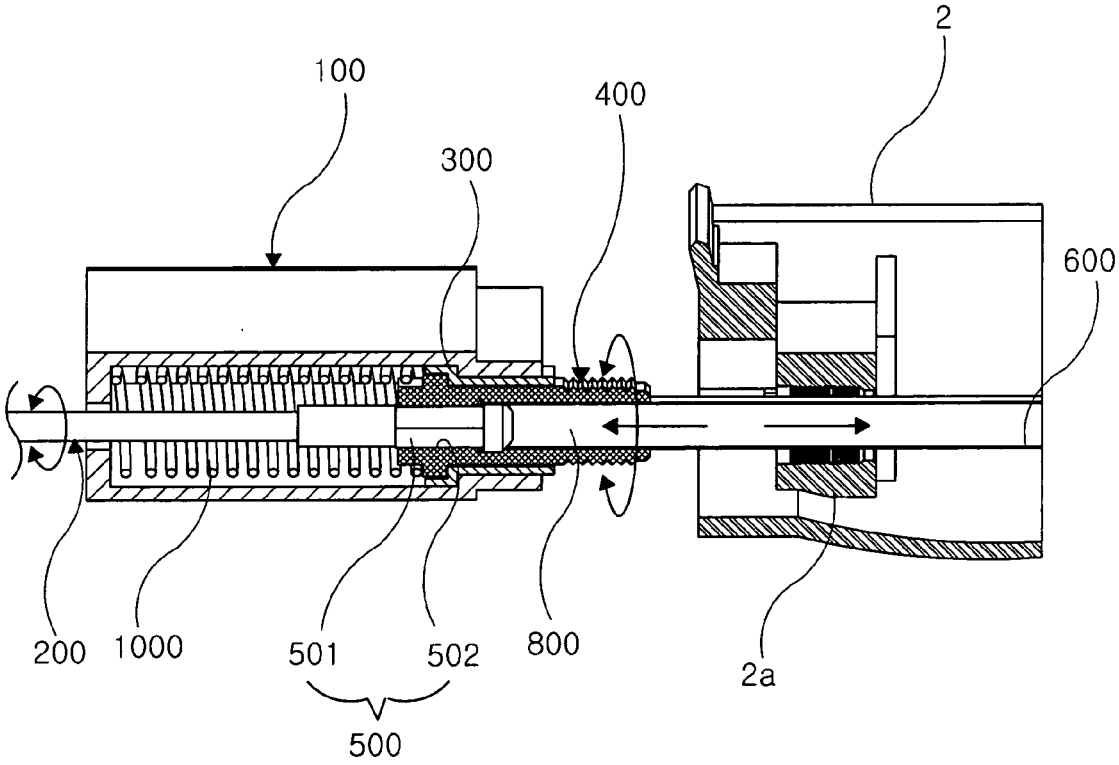
FIG. 10 is a partially-broken perspective view illustrating the antenna coupling device according to the first embodiment of the present invention before it is coupled to an antenna bushing.
Figure 11:
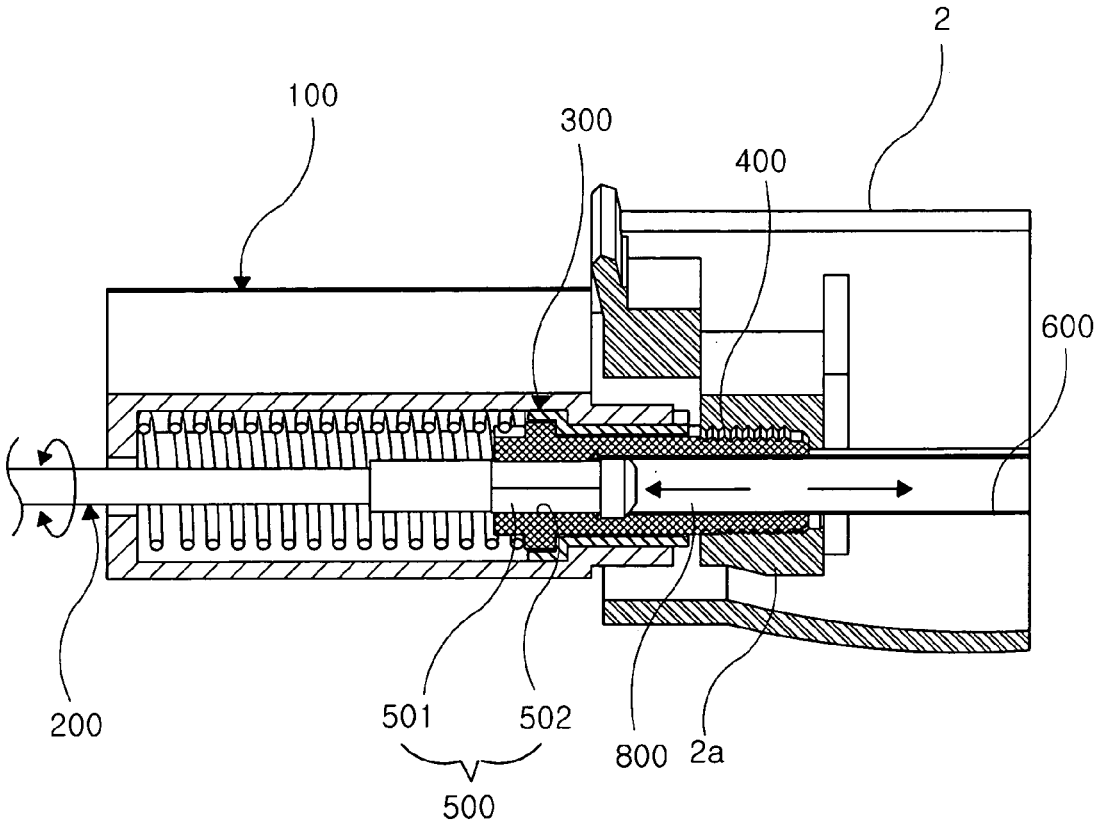
FIG. 11 is a partially-broken perspective view illustrating the antenna coupling device according to the first embodiment of the present invention after it is coupled to the antenna bushing with the rod antenna extended.
Figure 13:
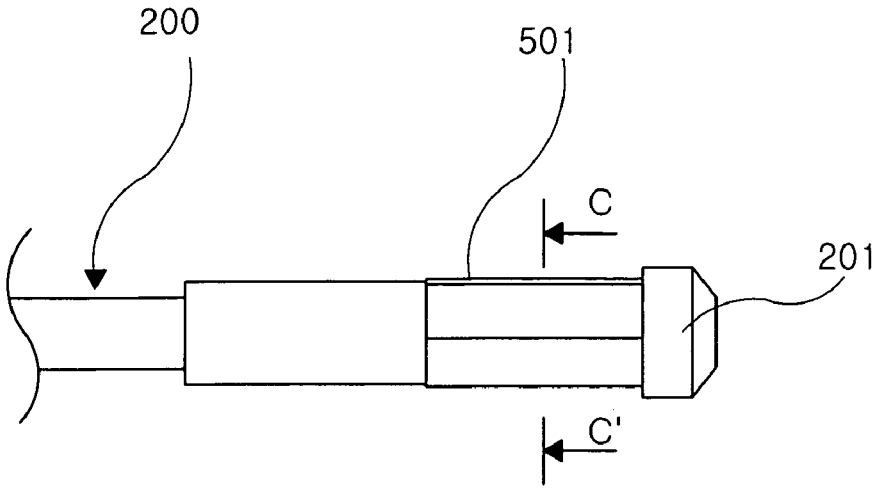
FIG. 13 is a side view illustrating a rod-shaped stopper included in the antenna coupling device according to the first embodiment of the present invention.
Figure 14:
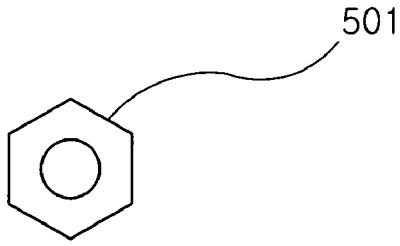
FIG. 14 is a cross-sectional view taken along the line C–C' of FIG. 13.

When it is desired to threadedly couple the antenna coupling member 400 with the antenna bushing 2*a*, the antenna 200 completely protrudes from the antenna housing 100. In this state, the restraining means 500 can operate to engage the antenna 200 with the antenna coupling member 400. That is, when the antenna 200 completely protrudes from the antenna housing 100, the rod-shaped stopper 501, which extends from the inner end of the antenna 200 to a desired length while having a polygonal cross-section, as shown in FIGS. 13 and 14, is engaged with the polygonal stopper bore 502 formed at one end of the antenna coupling member 400. Accordingly, the antenna coupling member 400 is restrained by the antenna 200. When the antenna 200 rotates in this state, the antenna coupling member 400 is rotated, as shown in FIGS. 10 and 11. At this time, the antenna housing 100 is maintained at a fixed state. Since the antenna coupling member 400 is provided with threads at the other end thereof protruded from the annular reinforcing member 300, it can be threadedly coupled with the antenna bushing 2*a* by the threads in accordance with the rotation of the antenna coupling member 400.

Figure 12:
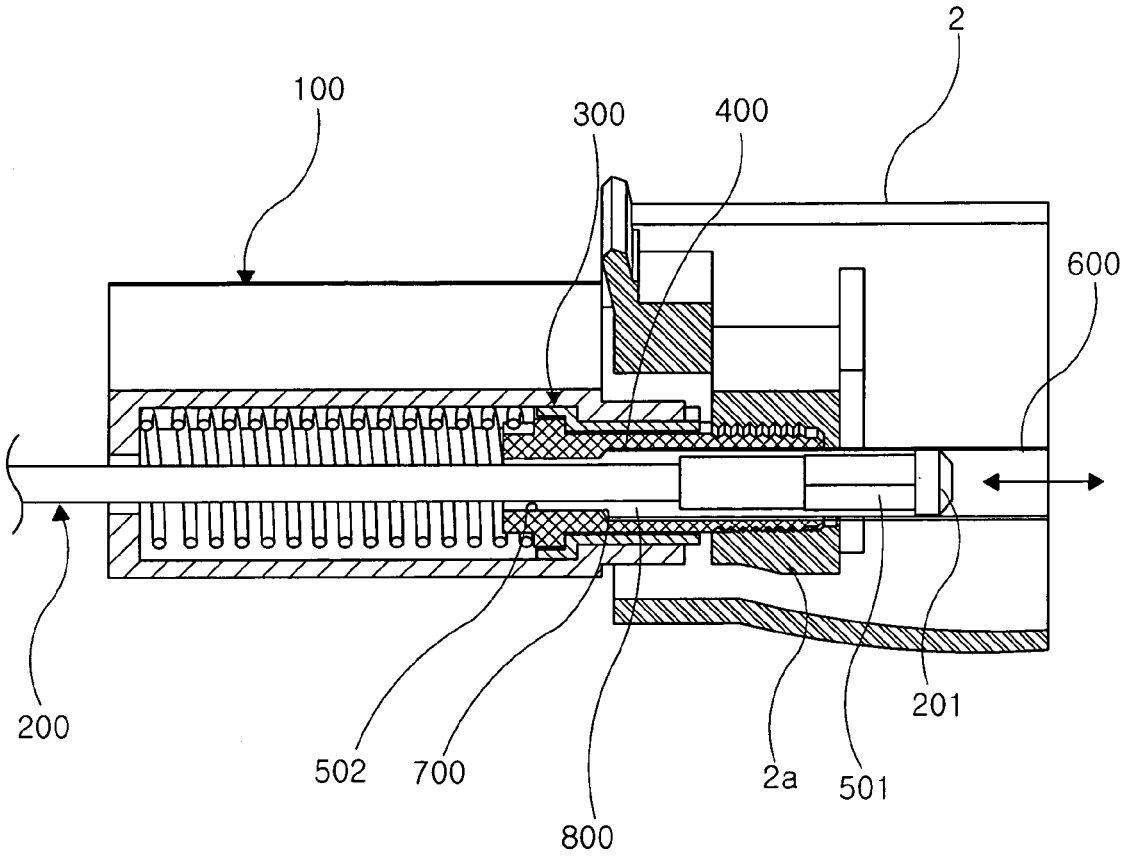
FIG. 12 is a partially-broken perspective view illustrating the antenna coupling device of FIG. 11 with the rod antenna partially retreated.
Figure 19:
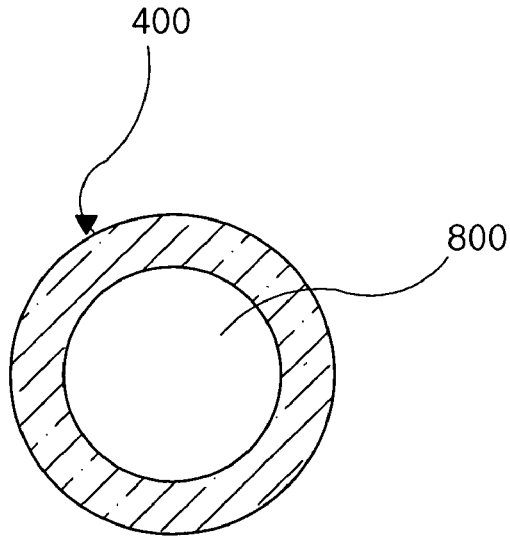
FIG. 19 is a cross-sectional view taken along the line E–E' of FIG. 16.

When the antenna 200 is retracted through the antenna housing 100 into the terminal body 1 in the state in which the antenna coupling member 400 is threadedly coupled with the antenna bushing 2*a*, the rod-shaped stopper 501 is separated from the stopper bore 502, as shown in FIG. 12. The rod-shaped stopper 501 is then introduced into the circular bore 800 having a diameter larger than the diameter of the circumscribed circle of the rod-shaped stopper 501, as shown in FIG. 19. Accordingly, the antenna can be freely rotated, and the restraint of the antenna coupling member 400 by the antenna is released. Thus, the coupling of the antenna unit to the terminal body is completed.

The assembling procedure and operation of the antenna coupling device having the above described configuration according to the second embodiment of the present invention will be described.

Figure 15:
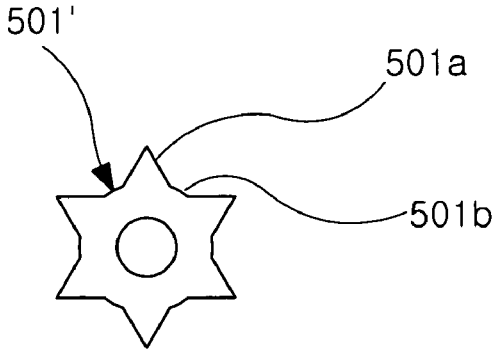
FIG. 15 is a cross-sectional view illustrating a second embodiment of the rod-shaped stopper.
Figure 16:
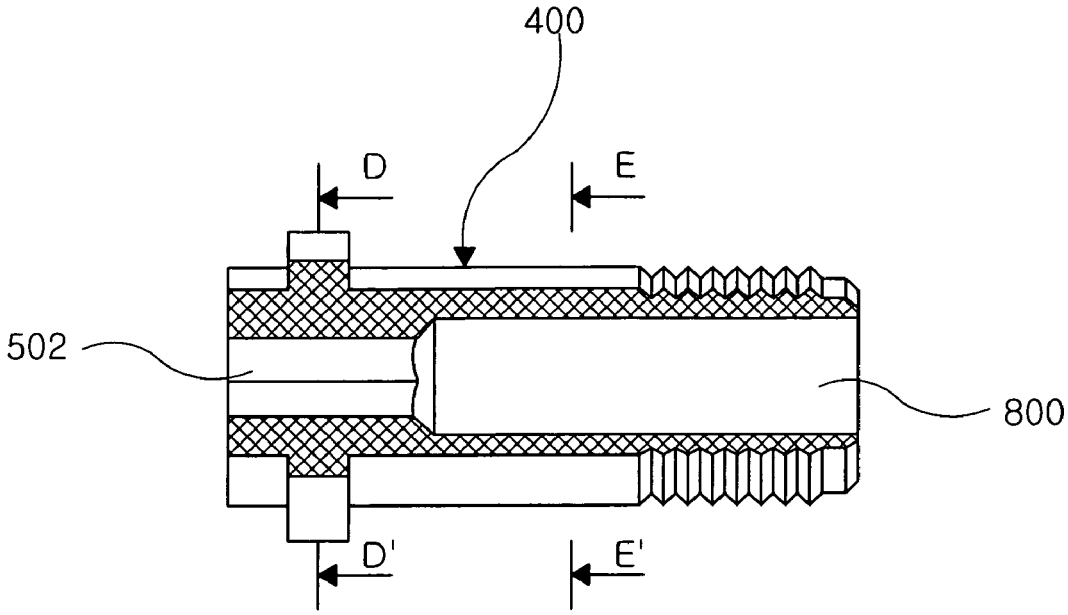
FIG. 16 is a sectional view illustrating the antenna coupling member included in the antenna coupling device according to the first embodiment of the present invention.
Figure 17:
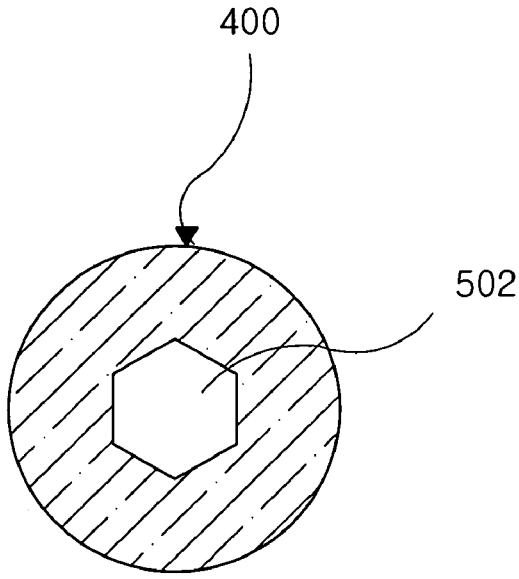
FIG. 17 is a cross-sectional view taken along the line D–D' of FIG. 16.
Figure 18:
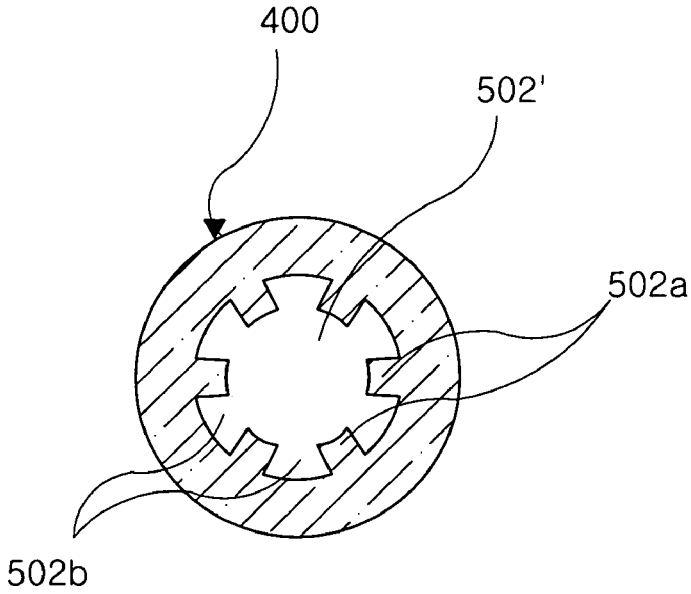
FIG. 18 is a sectional view illustrating the antenna coupling member included in the antenna coupling device according to the second embodiment of the present invention.

As shown in FIGS. 15 and 18, the restraining means 500 according to this embodiment comprises the rod-shaped stopper 501' extending from the inner end of the antenna 200 while being provided at a circumferential surface thereof with the first protrusions and grooves 501*a* and 501*b* extending longitudinally along the rod-shaped stopper 501', and the stopper bore 502' formed at one end of the antenna coupling member 400 while being provided at a circumferential surface thereof with the second protrusions and grooves 502*a* and 502*b* extending longitudinally along the stopper bore 502'.

Accordingly, when the antenna 200 completely protrudes from the antenna housing 100, the first protrusions and grooves 501*a* and 501*b* of the rod-shaped stopper 501' are engaged with the second grooves and protrusions 502*b* and 502*a* of the stopper bore 502', respectively. As a result, the antenna coupling member 400 is restrained by the antenna 200. When the antenna 200 rotates in this state, the antenna coupling member 400 is rotated. At this time, the antenna housing 100 is maintained at a fixed state. Accordingly, the antenna coupling member 400 can be threadedly coupled with the antenna bushing 2*a* by the threads formed at the other end of the antenna coupling member 400, in accordance with the rotation of the antenna coupling member 400.

When the antenna 200 is retracted through the antenna housing 100 into the terminal body 1 in the state in which the antenna coupling member 400 is threadedly coupled with the antenna bushing 2*a*, the first protrusions and grooves 501*a* and 501*b* of the rod-shaped stopper 501' are disengaged from the second grooves and protrusions 502*b* and 502*a* of the stopper bore 502', respectively. The rod-shaped stopper 501 is then introduced into the circular bore 800 having a diameter larger than the diameter of the circumscribed circle of the rod-shaped stopper 501, as shown in FIG. 19. Accordingly, the antenna can be freely rotated, and the restraint of the antenna coupling member 400 by the antenna is released. Thus, the coupling of the antenna unit to the terminal body is completed.

As apparent from the above description, the antenna coupling member is restrained by the antenna in accordance with the configuration of the restraining means. Accordingly, it is possible to easily couple the antenna unit to the terminal body while achieving an enhancement in coupling force.

While the present invention has been described in connection with what is presently considered to be the most practical and preferred embodiment, it is to be understood that the invention is not limited to the disclosed embodiments, but, on the contrary, it is intended to cover various modifications within the spirit and scope of the appended claims.

What is claimed is:

1. An antenna coupling device for coupling an antenna unit to a terminal body of a mobile terminal, the antenna unit including an antenna housing adapted to be coupled to the terminal body, and an antenna extending through the antenna housing into the terminal body at an inner end thereof, comprising:

an antenna coupling member rotatably fitted in the antenna housing at one end of the antenna housing facing the terminal body; and restraining means for selectively engaging the antenna with the antenna coupling member to restrain the antenna coupling member by the antenna, thereby causing the antenna coupling member to be coupled to an antenna bushing provided at the terminal body in accordance with rotation of the antenna.

2. The antenna coupling device according to claim 1, wherein the antenna coupling member is fitted, at one end thereof, in the antenna housing while having, at the other end thereof, threads to be threadedly coupled to the antenna bushing.

3. The antenna coupling device according to claim 1, wherein the antenna coupling member is made of a metal material.

4. The antenna coupling device according to claim 1, wherein the antenna coupling member has a stopper radially protruding from an outer circumferential surface of the antenna coupling member near one end of the antenna coupling member fitted in the antenna housing, and adapted to prevent the antenna coupling member from being separated from the antenna housing.

5. The antenna coupling device according to claim 1, further comprising:

an annular reinforcing member interposed between the antenna housing and the antenna coupling member, and adapted to reinforce a coupling force of the antenna coupling member.

6. The antenna coupling device according to claim 5, wherein the annular reinforcing member is made of a metal material.

7. The antenna coupling device according to claim 1, wherein the restraining means comprises:

a rod-shaped stopper provided at a portion of the antenna positioned near an antenna stopper formed at the inner end of the antenna, the rod-shaped stopper having a predetermined length and a polygonal cross-section; and a stopper bore formed at one end of the antenna coupling member and having a polygonal cross-section corresponding to that of the rod-shaped stopper, and adapted to be engagable with the rod-shaped stopper, whereby the antenna and the antenna coupling member can rotate simultaneously.

8. The antenna coupling device according to claim 7, wherein the antenna coupling member is formed with an inclined guide surface at one end of the stopper bore positioned toward the other end of the antenna coupling member, the inclined guide surface being adapted to come into contact with an end of the rod-shaped stopper opposite to the other end of the antenna coupling member, thereby guiding the rod-shaped stopper into the stopper hole.

9. The antenna coupling device according to claim 7, wherein the polygonal cross-section is a regular hexagonal cross-section.

10. The antenna coupling device according to claim 1, wherein the restraining means comprises:

a rod-shaped stopper provided at a portion of the antenna positioned near an antenna stopper formed at the inner end of the antenna, the rod-shaped stopper having a predetermined length and being provided at a circumferential surface thereof with a plurality of first protrusions extending longitudinally along the rod-shaped stopper, and a plurality of first grooves each arranged between adjacent ones of the first protrusions; and a stopper bore formed at one end of the antenna coupling member, the stopper bore being provided at a circumferential surface thereof with a plurality of second protrusions extending longitudinally along the stopper bore, and a plurality of second grooves each arranged between adjacent ones of the second protrusions.

11. The antenna coupling device according to claim 10, wherein the rod-shaped stopper has a star-shaped cross-section.

12. The antenna coupling device according to claim 10, wherein the protrusions and grooves are symmetrically formed, and each of the protrusions is provided with inclined surfaces.

13. The antenna coupling device according to claim 7, wherein the rod-shaped stopper has a size such that the diameter of a circumscribed circle thereof is larger than the diameter of the antenna.

14. The antenna coupling device according to claim 7, wherein the antenna coupling member has a circular bore extending axially from the stopper bore through the antenna coupling member while serving to receive the rod-shaped stopper separated from the stopper bore when the antenna is retracted into the terminal body, the circular bore having a diameter larger than a diameter of a circumscribed circle of the rod-shaped stopper to prevent the antenna coupling member from being restrained by the antenna.

15. The antenna coupling device according to claim 10, wherein the rod-shaped stopper has a size such that the diameter of a circumscribed circle thereof is larger than the diameter of the antenna.

16. The antenna coupling device according to claim 10, wherein the antenna coupling member has a circular bore extending axially from the stopper bore through the antenna coupling member while serving to receive the rod-shaped stopper separated from the stopper bore when the antenna is retracted into the terminal body, the circular bore having a diameter larger than a diameter of a circumscribed circle of the rod-shaped stopper to prevent the antenna coupling member from being restrained by the antenna.

* * * * *